United States Patent [19]

Meredith

[11] 4,188,019

[45] Feb. 12, 1980

[54] FENCING CONSTRUCTION

[75] Inventor: Harold F. Meredith, Mississauga, Canada

[73] Assignee: Meredith Manufacturing Co. Limited, Toronto, Canada

[21] Appl. No.: 935,759

[22] Filed: Aug. 22, 1978

[30] Foreign Application Priority Data

Aug. 15, 1978 [CA] Canada ..... 309355

[51] Int. Cl.[2] ..... E04H 17/16

[52] U.S. Cl. ..... 256/24; 256/65; 256/73

[58] Field of Search ..... 256/65, 21, 22, 24, 256/25, 73; 52/823; 98/121 R

[56] References Cited

U.S. PATENT DOCUMENTS

| | | | |
|---|---|---|---|
| 3,101,929 | 8/1963 | Dvore | 256/24 |
| 3,120,036 | 2/1964 | Minds, Jr. | 98/121 R |
| 3,234,697 | 2/1966 | Toti et al. | 256/24 UX |
| 3,452,501 | 7/1969 | Zimmer et al. | 52/823 X |

*Primary Examiner*—Andrew V. Kundrat
*Attorney, Agent, or Firm*—Sim & McBurney

[57] ABSTRACT

There is provided a fencing panel having upper and lower transverse members each defining a channel opening toward the other. The fence includes a plurality of elongated upright members, the ends of each upright member being lodged in the channels, each upright member being of resiliently deformable material. The upright members have an unstressed cross-section which could not be received in the channels, but is such as to be capable of resilient deformation so that it can be received in the channels, whereby the resiliency of the upright member urges parts of the cross-section against the channels thus binding the upright members within the channels.

8 Claims, 6 Drawing Figures

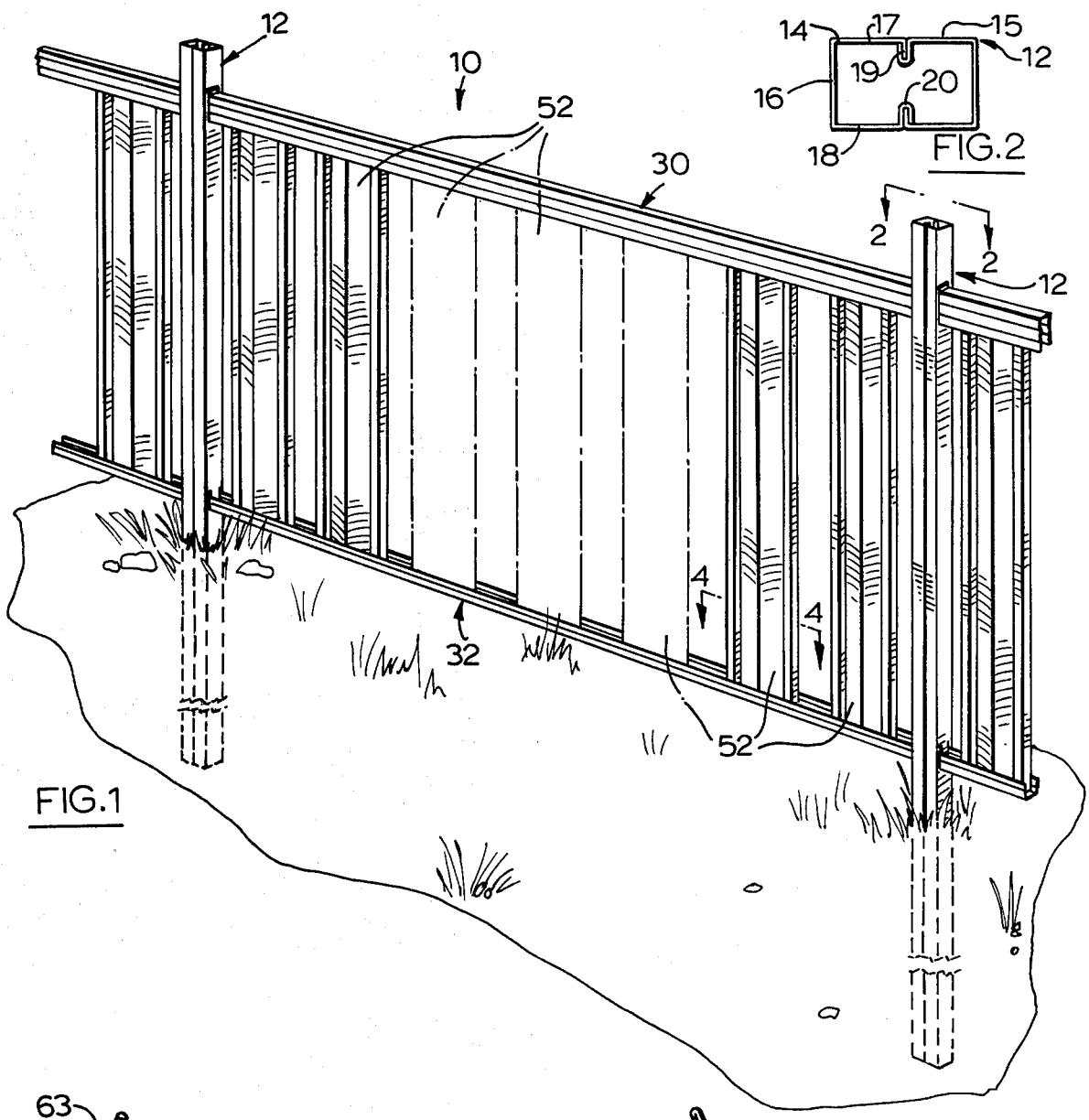
FIG.1
FIG.2
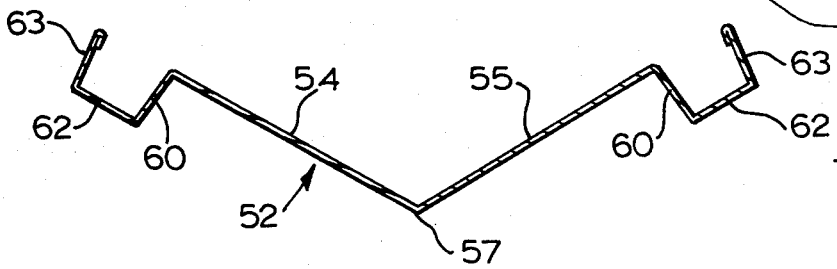
FIG.3
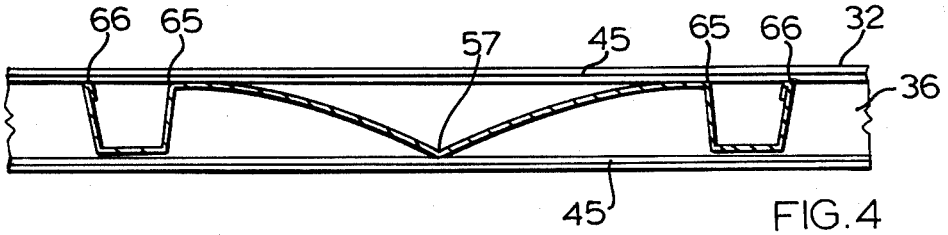
FIG.4

FENCING CONSTRUCTION

This invention relates generally to fencing construction, and has to do particularly with a fencing construction in which the various members are retained in position without requiring specific fastening means.

BACKGROUND OF THIS INVENTION

Many conventional fencing constructions require nails, bolts, spot-welding and the like in order to maintain the various upright and transverse members in appropriate relation to each other, and to provide the requisite strength to the overall structure. Such conventional constructions obviously suffer from disadvantages relating to the time and effort necessary to assemble the fence.

GENERAL DESCRIPTION OF THIS INVENTION

An aspect of the present invention is to provide a fencing construction in which no fastening means are required within the specific fencing panels, and in which no fasteners are required to affix the fencing panels to the upright posts in the ground.

According to this invention there is provided a fencing panel comprising: an upper transverse member shaped to define a downwardly open channel, a lower transverse member shaped to define an upwardly open channel, both channels having substantially the same width, and a plurality of elongated upright members spanning between the transverse members, each upright member having its ends lodged in said open channels, each upright member being of resiliently deformable material and having an unstressed, generally V-shaped cross-section which defines an obtuse angle and which cannot be received in said channels when unstressed, the cross-section being shaped to be capable of resilient deformation to enlarge the obtuse angle, so that the cross-section is receivable within said channels, whereby the resiliency of the upright member urges parts of said cross-section against the channels, thereby binding said upright members within the channels.

GENERAL DESCRIPTION OF THE DRAWINGS

One embodiment of this invention is illustrated in the accompanying drawings, in which like numerals denote like parts throughout the several views, and in which:

FIG. 1 is a perspective view of an assembled fencing construction in accordance with this invention;

FIG. 2 is a plan view of an upright fence post, seen in the direction lines 2—2 in FIG. 1;

FIG. 3 is a sectional view through one of the main panel upright members in an unstressed or relaxed condition;

FIG. 4 is a sectional view taken at the line 4—4 in FIG. 1, showing the stressed position of an upright member within a transverse channel;

PARTICULAR DESCRIPTION OF THE DRAWINGS

Figure 5:
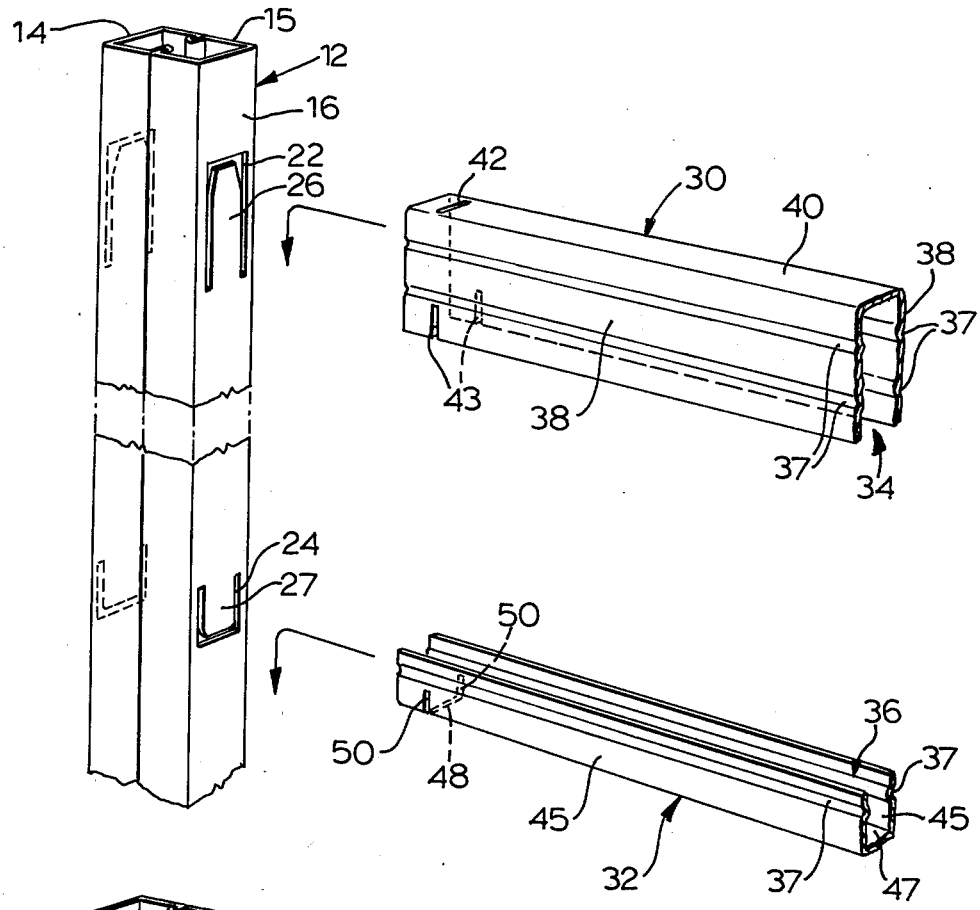
FIG. 5 is a perspective, separated view of a portion of a fence post and the upper and lower transverse members.
Figure 6:
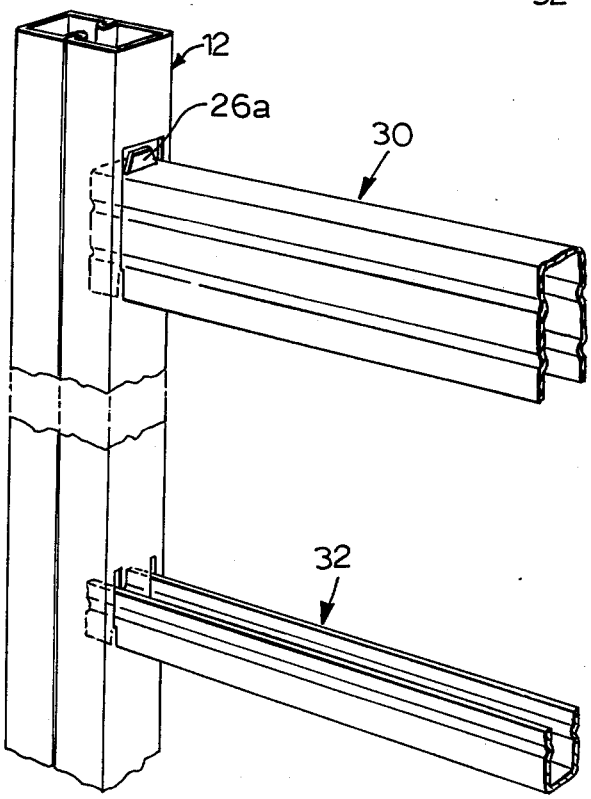
FIG. 6 is a view similar to FIG. 5, with all portions in assembled condition.

Attention is first directed to FIG. 1, in which a fencing construction 10 in accordance with this invention includes upright fence posts 12, which can be seen in FIGS. 2, 5 and 6 to consists of two C-shaped members 14 and 15. Each C-shaped member includes a back panel 16, two side panels 17 and 18, a single inner flange 19, and a hairpin inner flange 20. As can be seen in FIG. 2, the single inner flange 19 of each of the C-shaped members 14 and 15 fits within the hairpin flange 20 of the other, thus interlocking the two C-shaped members 14 and 15 together, to define the fence post 12.

As can seen in FIG. 5 and 6, each of the members 14 and 15 of fence post 12 has two channel-shaped apertures in the corresponding bottom wall 16. These include an upper channel-shaped aperture 22, and a lower channel-shaped aperture 24. The upper aperture 22 thus defines an upward tongue 26, which has its corners chamfered or tapered as can be seen in FIG. 5. The lower aperture 24 has a downwardly extending tongue 27, the corners of which are also rounded or chamfered.

The fence further includes an upper transverse member 30 and a lower transverse member 32. As can be seen in FIGS. 5 and 6, both of the upper and lower transverse members 30 and 32 are channel-shaped, with the upper channel 30 being shaped to define a downwardly open channel 34, and the lower transverse members 32 being shaped to define an upwardly open channel 36. Both of the channels 34 and 36 have substantially the same width, and in the embodiment illustrated, both of the channel members 30 and 32 are formed from rolled metal plate stock. Each of the channel members 30 and 32 includes longitudinal rib deformations 37 for additional strength. The channel 34 in the upper transverse member 30 is approximately twice as deep as the channel 36 in the lower transverse member 32.

The upper transverse member 30 has two side walls 38, and an end wall 40. Adjacent each of its ends, the upper transverse member 30 has a transverse slot 42 in the end wall 40, and two upward notches 43 in the free edges of the side walls 38. The slot 42 and the notches 43 are at the same longitudinal position in the upper transverse member 30, and are adapted to interfit with the tongue 26 and the bottom wall 16 of the respective member 14 or 15 of the fence post 12. More specifically, the upper end of the tongue 26 will extend upwardly through the slot 42, while the notches 43 will interfit with the two bottom ends of the aperture 22. The assembled condition is shown in FIG. 6. In order to assemble, the end of the upper transverse member 30 is first inserted into the aperture 22, until the tongue 26 comes even with the slot 42, at which point the upper transverse member 30 can move downwardly into the position shown in FIG. 6. To secure the transverse member in position, the upwardly projecting visible end **26*a* of the tongue 26 (see FIG. 6) can be hammered or bent over at rightangles, so that removal of the upper transverse member 30** from its interlocked position with respect to the fence post is not possible.

The lower transverse member 32 also has two side walls 45 and an end wall 47. Adjacent each of its ends, the lower transverse member has a transverse slot 48 in its end wall 47, the transverse slot 48 being continuous with upward slots 50 in the side walls 45. The upward slots 50 terminate short of the upper free edges of the side walls 45, as can be seen in FIG. 5. The lower transverse member 32 thus also achieves a secure fit with respect to the member 14 or 15 of the fence post 12, the method of assembly being first to insert the end of the lower transverse member 32 into the aperture 24 in aligned condition, until the slot 48 comes even with the bottom wall 16 of the respective member 14 or 15 of the fence post 12, upon which the lower transverse member can be dropped down to the position shown in FIG. 6.

Attention is now directed to FIGS. 1, 3 and 4, for a particular description of the portion of the fence spanning between the transverse members 30 and 32. This portion consists of a plurality of elonged upright members 52, each upright member 52 having its ends lodged in the channels 34 and 36, respectively, of the transverse members 30 and 32.

The upright members 52 are constructed of resiliently deformable material, for example resilient sheet metal, and they have an unstressed cross-section shown in FIG. 3 which is configured in such a way as to be incapable of being received in the channels 34 and 36. However, the cross-section can, upon resilient deformation into the appropriate configuration, be received within the channels. The resiliency of the upright members 52 will thus attempt to return the section to that shown in FIG. 3, thus urging portions of the cross-section against portions of the channels, and thereby binding the upright members within the channels.

More specifically, as seen in FIG. 3, the unstressed cross-section of each of the upright members 52 includes a first main panel 54 and a second main panel 55 joined at a vertex 57 to define a V-shape with a wide obtuse angle between the panels 54 and 55. At the end of each panel 54 and 55 (which can be considered to be the two arms of the "V" defined by the section shown in FIG. 3), there is provided a stiffening structure which resists longitudinal bending of the upright member. More specifically, the stiffening structure includes a first portion 60 extending substantially perpendicularly to its respective panel 54 and 55 (the arms of the "V"), a second portion 62 which extends in the same direction as the respective panel 54, 55, and a third portion 63 which extend substantially parallel with, but reversed in direction from, the first portion 60. As drawn in FIG. 3, the portions 60 and 63 are slightly diverging.

As seen in FIG. 4, when the V-shaped cross-section shown in FIG. 3 has been flattened out to some extent, the entire configuration is receivable within the channels, FIG. 4 showing the channel 36 of the lower transverse member 32. The points of bearing include the vertex 57 which bears against the lower of the two walls 45 as pictured in FIG. 4, and the locations 65 and 66 of the stiffening structure at the ends of each of the arms of the V-shaped cross-section (panels 54 and 55). The latter points bear against the other side wall 45 in FIG. 4, which is shown at the top of that drawing.

Due to the greater depth of the channel 34 in the upper transverse member 30, each upright member 52 can be assembled in a very simple manner. The upper end is first flattened by hand and inserted as far as possible into the upper channel 34, which brings the lower end of the upright member 52 clear of the upper edge regions of the lower transverse member 32. When this has been accomplished, the lower end of the upright member 52 is also flattened by hand and moved into position over the lower channel 36, whereupon the member 52 is simply pulled downwardly so that the lower end of the upright member 52 is inserted in the lower channel 36. The member 52 can be pulled all the way down until its bottom end seats in the bottom of the channel 36, without releasing the upper end of the member 52 from the upper channel 34, this being due to the difference in depths between the channels 34 and 36.

In the overall construction of the fence, it will be understood that the fence posts 12 would firstly be driven into the ground sequentially, during which the transverse members 30 and 32 would be put into position as discussed earlier, following which the upright members 52 would be inserted by hand one by one and arranged with the appropriate spacing between them. Because the securement between the upright members 52 and the transverse members 30 and 32 is merely one of frictional binding, it will be understood that spacing between the upright members 52 can be easily adjusted, that additional such members can be inserted at a later date, if desired, and that in general a considerable degree of flexibility is provided by the construction of this invention.

What I claim is:

1. A fencing panel comprising:

an upper transverse member shaped to define a downwardly open channel, a lower transverse member shaped to define an upwardly open channel, both channels having substantially the same width, and a plurality of elongated upright members spanning between the transverse members, each upright member having its ends lodged in said open channels, each upright member being of resiliently deformable material and having an unstressed, generally V-shaped cross-section which defines an obtuse angle and which cannot be received in said channels when unstressed, the cross-section being shaped to be capable of resilient deformation to enlarge the obtuse angle, so that the cross-section is receivable within said channels, whereby the resiliency of the upright member urges parts of said cross-section against the channels, thereby binding said upright members within the channels.

2. The panel claimed in claim 1, in which the upright members are of resilient sheet metal.

3. The panel claimed in claim 1 or claim 2, in which the section of each upright member includes, at the end of each arm of the "V", a stiffening structure which resists bending longitudinally of the upright member.

4. The panel claimed in claim 1 or claim 2, in which the channel in the upper transverse member is deeper than the channel in the lower transverse member.

5. The panel claimed in claim 1 or claim 2, in which the transverse members are rolled metal plate stock, and in which the channel in the upper transverse member is about twice as deep as that in the lower transverse member.

6. The panel claimed in claim 2, in which the ends of the arms of the V-shaped cross-section are bent to define at least one portion extending substantially perpendicular to its respective V-arm, thereby to stiffen the upright members against longitudinal bending.

7. The panel claimed in claim 6, in which each said end of each V-arm is further bent to define a second portion extending in the same direction as the V-arm, and a third portion extending substantially parallel with, but reversed in direction from, said one portion.

8. The panel claimed in claim 1, in which the transverse members are rolled metal plate stock, each having two side walls and an end wall, in which the channel in the upper transverse member is deeper than that in the lower transverse member, and in which the ends of each transverse member are received in channel-shaped apertures in the walls of fence posts formed of rolled metal plate stock, the apertures conforming to the section of the respective transverse members, the upper transverse member having, adjacent each end, a transverse slot in the end wall and upward notches in the free edges of the side walls, the slot and the notches being at the same longitudinal position in the member, the lower transverse member having, adjacent each end, a transverse slot in the end wall, said latter transverse slot being continuous with upward slots in the side walls of the lower member, said upward slots terminating short of the upper free edges of the side walls.

* * * * *